US008523638B2

(12) United States Patent
Grigsby

(10) Patent No.: US 8,523,638 B2
(45) Date of Patent: Sep. 3, 2013

(54) EDGE TOOL AND SHARPENER IN COMBINATION

(76) Inventor: Ele Grigsby, Louisville, KY (US)

( * ) Notice: Subject to any disclaimer, the term of this patent is extended or adjusted under 35 U.S.C. 154(b) by 390 days.

(21) Appl. No.: 12/872,413

(22) Filed: Aug. 31, 2010

(65) Prior Publication Data

US 2011/0053480 A1 Mar. 3, 2011

Related U.S. Application Data

(60) Provisional application No. 61/238,838, filed on Sep. 1, 2009.

(51) Int. Cl.
*B24D 15/06* (2006.01)

(52) U.S. Cl.
USPC ..... 451/371; 451/45; 451/555; 76/88

(58) Field of Classification Search
USPC ..... 451/175, 367, 370, 371, 378, 380, 451/45, 524, 555, 557, 558, 559; 76/82, 76/82.2, 88; D8/90–93
See application file for complete search history.

(56) References Cited

U.S. PATENT DOCUMENTS

| | | | | | |
|---|---|---|---|---|---|
| 471,679 | A * | 3/1892 | Spruce | 451/321 |
| 480,634 | A * | 8/1892 | Spruce | 451/321 |
| 523,908 | A | 7/1894 | Sly | |
| 805,332 | A | 11/1905 | Yow | |
| 956,350 | A * | 4/1910 | Hillstrom | 76/89.2 |
| 1,164,474 | A * | 12/1915 | Coon | 451/321 |
| 1,213,339 | A * | 1/1917 | D'Amato | 451/322 |
| 1,359,271 | A * | 11/1920 | Plummer | 451/369 |
| 1,675,981 | A * | 7/1928 | Lees | 451/320 |
| 1,770,538 | A | 7/1930 | Warner | |
| 2,128,591 | A | 8/1938 | McGill | |
| 2,131,626 | A | 9/1938 | Keith | |
| 2,458,257 | A * | 1/1949 | Donovan | 451/321 |
| 2,588,160 | A * | 3/1952 | Post | 451/320 |
| 2,644,279 | A | 7/1953 | Stankovich | |
| 2,864,206 | A | 12/1958 | Lane | |
| 3,934,287 | A * | 1/1976 | Howard | 7/158 |
| 4,512,111 | A | 4/1985 | Childers | |
| 4,961,288 | A * | 10/1990 | Ketteringham | 451/224 |
| 5,218,787 | A * | 6/1993 | Rice | 451/229 |
| 5,311,703 | A * | 5/1994 | Ketteringham | 451/65 |
| 5,582,542 | A | 12/1996 | Stein | |
| 5,955,202 | A * | 9/1999 | Steeg et al. | 428/457 |
| 6,030,281 | A * | 2/2000 | Cozzini et al. | 451/320 |
| 6,405,615 | B1 * | 6/2002 | Vermillion | 76/83 |
| 6,568,087 | B1 * | 5/2003 | Gringer | 30/169 |
| 7,104,876 | B1 | 9/2006 | Lin | |
| 2009/0004956 | A1 * | 1/2009 | Smith | 451/371 |
| 2009/0088053 | A1 * | 4/2009 | Hummel | 451/380 |
| 2011/0201261 | A1 * | 8/2011 | Grigsby | 451/555 |

* cited by examiner

*Primary Examiner* — Lee D Wilson
*Assistant Examiner* — Tyrone V Hall, Jr.

(57) ABSTRACT

A scraper in combination with a sharpener provides consistent sharpening of the scraper blade. The scraper has a scraper blade, blade holder, and bearing surface. The sharpener has a sharpening element and a guide generally parallel to the sharpening element. The bearing surface of the scraper fits the guide of the sharpener and the scraper blade contacts the sharpening element. The scraper can be drawn along the guide to draw the blade along the sharpening element. The bearing surface and guide keep the blade in consistent and correct relation to the sharpening element to provide proper sharpening of the scraper blade. Adaptors may be used to sharpen additional types of blades or tools on the sharpener and different types of sharpening elements may be used in the sharpener.

2 Claims, 6 Drawing Sheets

EDGE TOOL AND SHARPENER IN COMBINATION

RELATED U.S. APPLICATION DATA

This application claims priority from U.S. provisional application No. 61/238,838, filed on Sep. 1, 2009. The entire disclosure contained in U.S. provisional application 61/238,838, including the attachments thereto are incorporated herein by reference.

FIELD OF THE INVENTION

This invention relates to blade sharpeners and more particularly to scrapers and scraper blade sharpeners.

BACKGROUND

Scrapers are utilized in removing paint, finish and fine layers of wood among other things in areas that motorized tools are unable to operate. Typically, scraper blades are sharpened freehand with a file after being attached to a blade holder or handle by some means. It takes considerable practice, skill, and attention to the task to sharpen a blade by freehand methods and obtain a straight and sharp edge. A blade being freehand sharpened with a file usually results in the center hollowed, edges rounded or a combination of both, resulting in a gouged or uneven work surface when the defectively sharpened blade is used on the work surface. In addition to quality issues, the typical method of sharpening a blade, for example, a scraper blade, presents safety issues. In the sharpening process, pressure is applied to the blade with a file while moving the file across the blade. Workers sometimes slip off the blade edge with the file while moving the hand holding the file towards the blade, which can result in injury, such as a cut to the hand that is holding the file.

Understanding the dynamics to sharpen the blade does not always result in the ability to apply that knowledge. It takes time and experience. Many workers never achieve this skill, even after considerable effort. The several embodiments of the present apparatus and method eliminate the need to acquire the skill and provide a willing, but untrained, individual the ability to sharpen a blade in a safe, effective, and expeditious manner.

RELEVANT ART

U.S. Pat. No. 523,908 by Sly is for a "Machine for Sharpening Shears." In Sly, an arm is attached one of the shear halves. The shear half is placed on a sharpening stone while the other end of the arm is placed in a guide. The arm keeps the shear blade at the correct angle while it is being moved on the stone.

U.S. Pat. No. 1,359,271 by Plummer is for a "Universal Tool Sharpener". In Plummer, an abrading block rests on a base. A cylindrical guide bar fixed at each end spans above the abrading block. A carrier is fitted over the end of the guide rod to mount it on the guide rod. Tools can be fixed in the carrier and arranged so that their point or blade contacts the abrading block. Sliding the carrier along the guide rod moves the tools point or blade along the abrading block to sharpen the tool.

U.S. Pat. No. 1,675,981 by Lees is for a "Graver Sharpener and Facet Cutting Machine." In Lees, a wet stone rests on a panel with a block running along an edge of the wet stone and support guide block support one end of each of two arcuate guide rods. The other ends of the guide rods are on support posts. A straight guide bar has nuts with apertures at each of its ends and spans the arcuate guide rods and can slide along the arcuate guide rods. A block for holding a graver is slid over the end of the straight guide bar to assemble it to the guide bar. The block can pivot about the straight guide, and it can slide along the straight guide. A graver held by the block can be put in contact with the wet stone and moved along it to sharpen it, while being maintained at a desired angle.

SUMMARY

One embodiment of the present invention is a bladed tool and sharpener combination with the means to abrade the blade edge square to its face at an angle resulting in the blade being sharpened. The sharpener has a sharpening element and a guide such as a guide rod. The bladed tool has a bearing surface on it matching the guide. By placing the bearing surface of the bladed tool on the guide rod of the sharpener, the blade of the bladed tool can be maintained in contact with the sharpening element in correct orientation while being moved back and forth. In one embodiment the bladed tool is a scraper. Alternative embodiments include adapters that can be substituted into the combination tool and used to sharpen other bladed tools such as chisels. These adapters do not need to be permanently mounted as part of the combination tool to be used. Among other things, this provides a means of sharpening a larger variety of blades and bladed tools.

As discussed above, the article and method of the present invention overcomes the disadvantages inherent in prior art methods and prior art devices. In this respect, before explaining at least one embodiment of the invention in detail, it is to be understood that the invention is not limited in its application to the details of construction and/or to the arrangement of the support structure set forth in the following description or illustrated in the drawings. The invention is capable of other embodiments and of being practiced and carried out in various and diverse ways. Also, it is to be understood that the phraseology and terminology employed herein are for the purposes of description and should not be regarded as limiting.

Accordingly, those skilled in the art will appreciate that the concept upon which this invention is based may readily be utilized as a basis for the design of other structures, methods, and systems for carrying out the purposes of the present invention. It is important, therefore, that the claims be regarded as including such equivalent constructions insofar as they do not depart from the spirit and scope of the present invention.

Furthermore, the purpose of the foregoing Abstract is to enable the U.S. Patent and Trademark Office and the public generally, and especially including the practitioners of the art who are not familiar with patent or legal terms or phraseology, to determine quickly from a cursory inspection, the nature and essence of the technical disclosure of the application. The Abstract is neither intended to define the invention of the application, nor is it intended to be limiting to the scope of the invention in any respect.

BRIEF DESCRIPTION OF THE DRAWINGS

Additional utility and features of this invention will become more fully apparent to those skilled in the art by reference to the following drawings, wherein all components are designated by like numerals and described more specifically.

DETAILED DESCRIPTION OF EMBODIMENTS

Figure 5A:
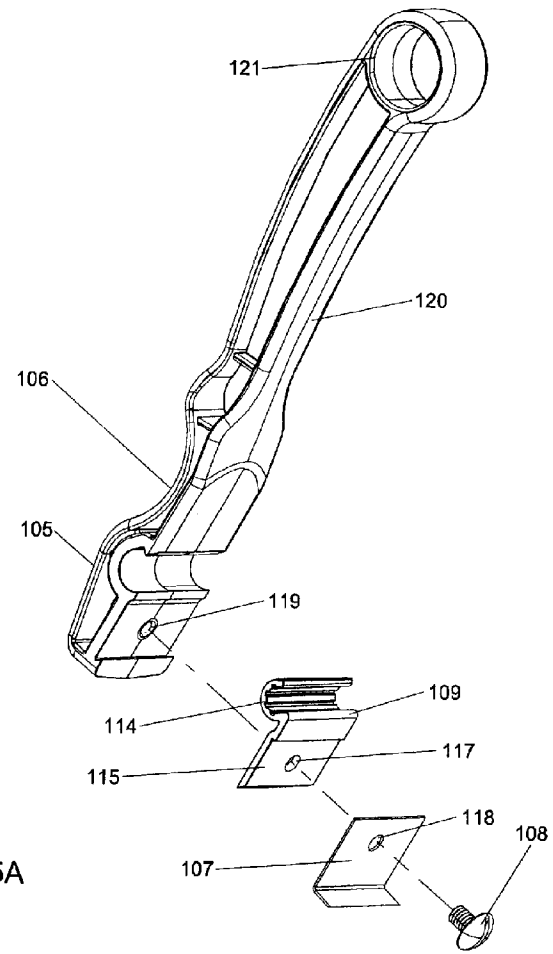
FIG. 5A is an exploded perspective view of the scraper tool of FIG. 5, including the blade holder, bushing, blade, and clamp screw.
Figure 5:
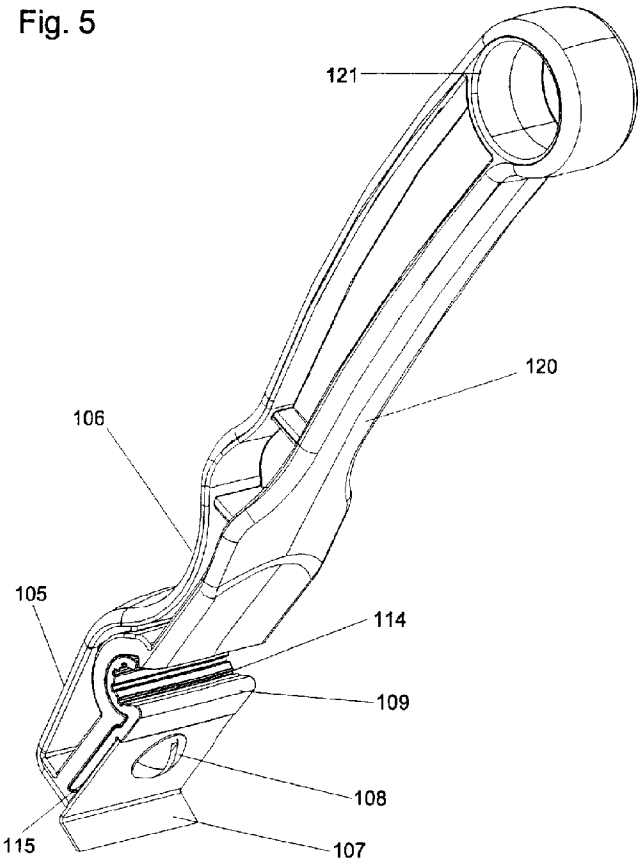
FIG. 5 is a perspective view of the scraper tool of FIG. 1 apart from the sharpener.

FIGS. 1, 2, 3, and 4 illustrate a first embodiment of a scraper kit, which includes a scraper tool and a sharpener, while FIGS. 5 and 5A illustrate a scraper apart from sharpener.

The embodiment of the scraper tool shown in FIGS. 1-5A includes blade holder 105, scraper blade 107, bushing 109, and clamp screw 108. Referring now to FIGS. 5 and 5A, it can be seen that bushing 109 is removable and provides a slide bearing 114 at least partially open with a slot along its length and a blade mount surface 115. Slide bearing 114 is sized to fit a guide rod 101 such as shown in FIGS. 1-4. To sharpen blade 107 while mounted in bladed holder 105, slide bearing 114 is placed over guide rod 101, blade holder 105 is rotated to bring blade 107 into contact with the sharpening surface 116 of sharpening element 102, and blade holder 105 is slid back and forth on guide rod 101 while maintaining contact between blades 107 and sharpening surface 116.

The sliding of blade holder 105 back and forth on guide rod 101 produces wear on slide bearing 114 and over time bearing 114 may become worn beyond effectiveness. Because of this, in the embodiment shown in FIGS. 1-5A, bearing 114 is made as part of removable bushing 109 which also incorporates blade mount surface 115. As shown in FIG. 5A, both blade mount surface 115 of bushing 109 and blade 107 have apertures, blade mount surface aperture 117 and blade aperture 118, respectively. Blade holder 105 has an aperture, or hole 119, which may be threaded. Clamp screw 108 passes through blade aperture 118 of blade 107 and bushing aperture 117 of bushing 109 and threads into hole 119 in blade holder 105 to clamp blade 107 and bushing 109 to blade holder 105. The blade 107 typically is made of metal, such as steel. The bushing 109 may be made of metal, plastic or other desired material.

Although the embodiment of FIGS. 1-5A has bearing 114 as a part of removable bushing 109, that is not a requirement. Other embodiments may have bearing 114 made integral to the scraper, either from the same material as the rest of the scraper, or as an insert resistant to wear, such as a metal insert. Similarly, other embodiments may have a blade mount surface integral to the scraper as opposed to being part of removable bushing 109. In the embodiments shown in FIGS. 1-5A, having blade aperture 118 and bushing aperture 109 arranged concentrically over holes 119 when blade 107 and bushing 109 are mounted on blade holder 105, allows a single clamp screw 108 to clamp both items onto blade holder 105. An alternative mechanism could be used for clamping instead of a screw, if desired. It is conceivable that, in other embodiments, blade 107 could be made permanent in blade holder 105, but that is unlikely, since blade 107 wears from use and sharpening, and once a permanent blade is worn, its whole scraper would have to be thrown away. Additionally, in some embodiments, slide bearing 125 may be recessed in a notch in blade holder 126 with surfaces of the notch leading back to terminate at the bearing surface. The walls of the notch facilitate keeping the scraper engaged. Also, while the bearing surface is shown as cylindrical, it could also be comprised of tow or more flat surfaces.

Handle 120 extends from blade holder 105. Where handle 105 joins blade holder 105 there is a broad, curved, indented design element, or hand rest 106, in the top surface of the scraper to fit the heel of a person's palm to aid in applying pressure to the blade and or work surface. Hand rest 106 is most fully seen in FIG. 4 and may be seen in profile in FIG. 3. There are several manners in which hand rest 106 may be used. One manner includes pressing into hand rest 106 with the heel of the palm of one hand to apply pressure.

At the end of handle 120 distal from blade holder 105 is ring 121. Ring 121 is large enough that at least one finger may be inserted through it to pull the scraper. This provides a strong, positive grip for pulling the scraper while it is in use. The combination of hand rest 106 and ring 121 on the scraper allows a user to both apply pressure to the scraper and pull steadily notwithstanding the pressure being applied. As a grip, ring 121 allows the scraper to be used easily at a wide range of angles.

Figure 2:
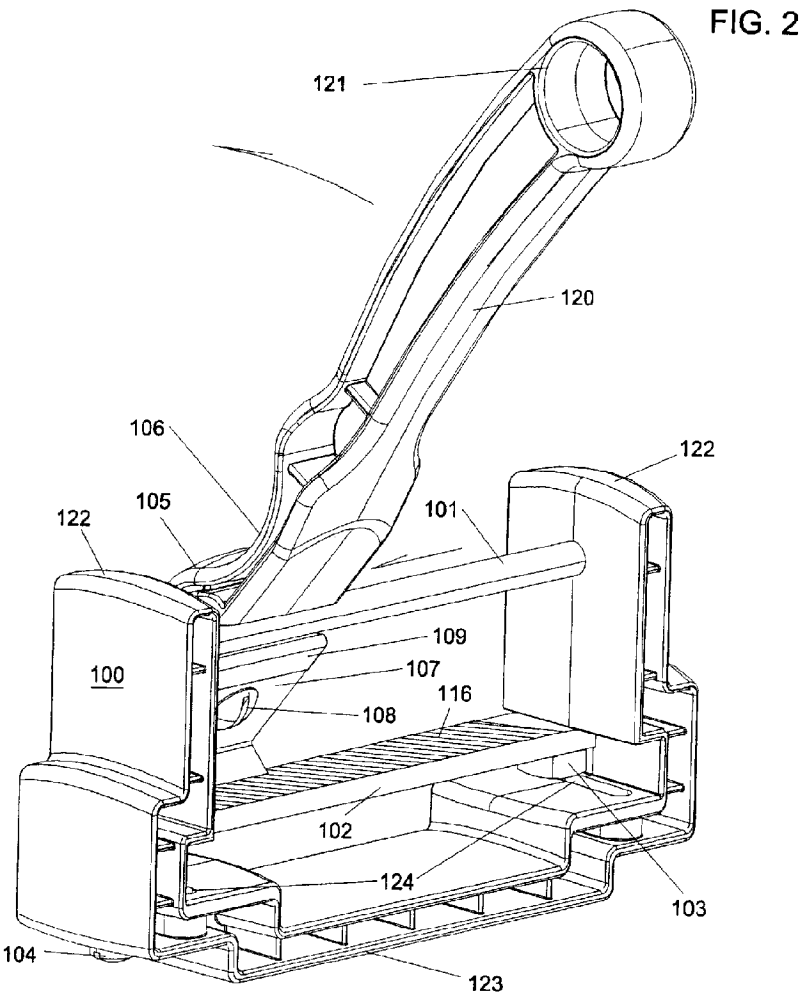
FIG. 2 is the same view as FIG. 1, but with the scraper tool having moved to a second position on the sharpener.
Figure 1:
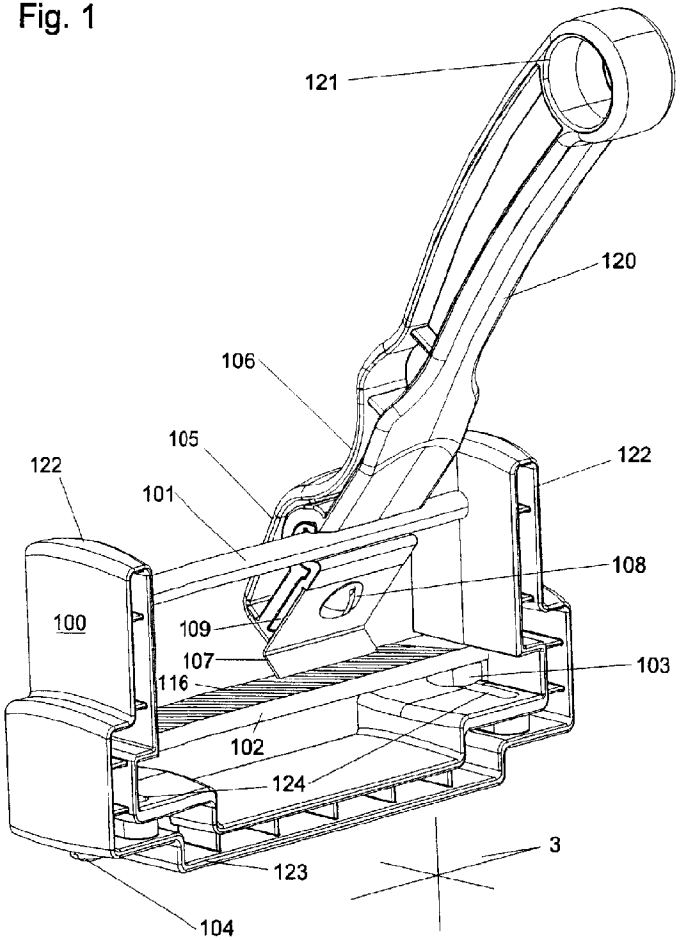
FIG. 1 is a perspective view of a first embodiment of a scraper tool in position on a first embodiment of a sharpener.
Figure 4:
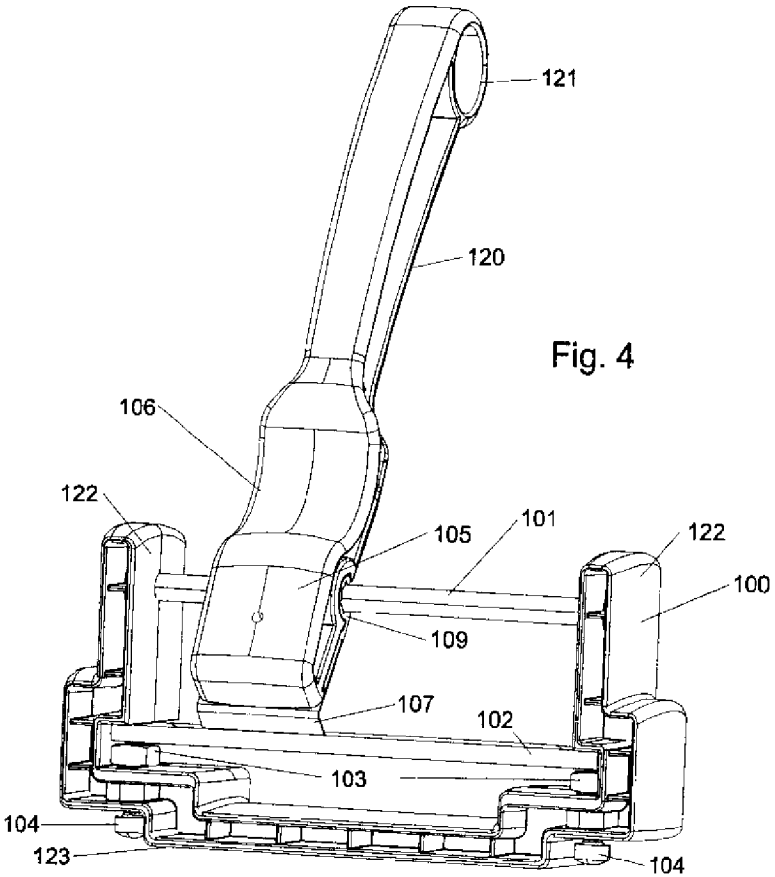
FIG. 4 is a front perspective view of the embodiment of FIG. 1.
Figure 6:
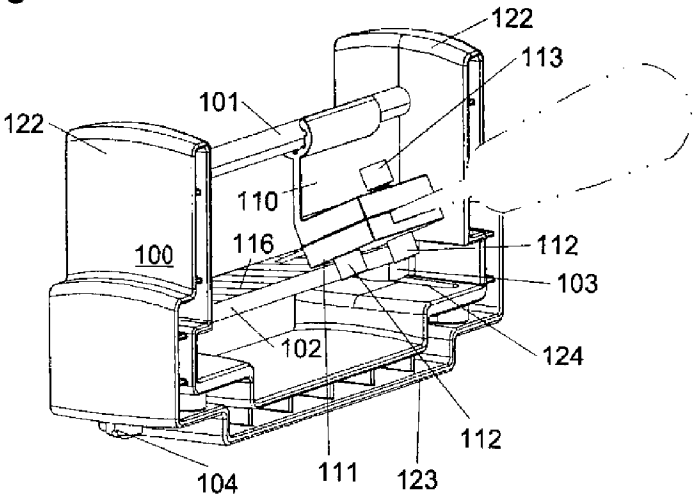
FIG. 6 is a perspective view of the sharpener of FIG. 1 with an adaptor for sharpening other tools.

In the embodiments shown in FIGS. 1, 2 and 6, the sharpening tool includes a frame 100, a guide rod 101, a sharpening element 102. Guide rod 101 in this embodiment has a cylindrical shape and can be made of solid or hollow material of most any kind that would be rigid enough and strong enough to resist deflection. Guide rod 101 is held between two parallel uprights 122 extending from base 123 of frame 100, which could be made of most any material. The presence of two uprights in the embodiments shown allows guide rod 101 to be securely supported at each end which provides a level of rigidity and limits the sliding motion of a blade holder. However, other embodiments may have frames with other configurations and two uprights are not a requirement. Frame 100 may be made by casting, molding, or by other means. Sharpening element 102 in this embodiment is a mill bastard file. Other embodiments may employ other sharpening elements such as files of other grades, a diamond abrasion tool, a honing stone, etc.

In the embodiments shown in FIGS. 1-5A, the position of sharpening element 102 may be adjusted, and sharpening element 102 may even be removed and replaced. Sharpening element 102 is clamped into place between base 123 and the bottom of uprights 122 by tensioning screw 104 and nut 103. Nut 103 is positioned over slot 124 and tensioning screw 104 is turned through nut 103 until its end contacts the bottom of sharpening element 102 and generates enough force to securely hold sharpening element 102 in place. Slots 124 allow tensioning screws 104 and nut 103 and each end of sharpening element 102 to be moved so that they are centered on sharpening element 102 as well as allowing the overall position of sharpening element 102 to be adjusted. Sharpening element 102 may be removed by sufficiently relaxing the hold of tensioning screws 104.

Figure 7:
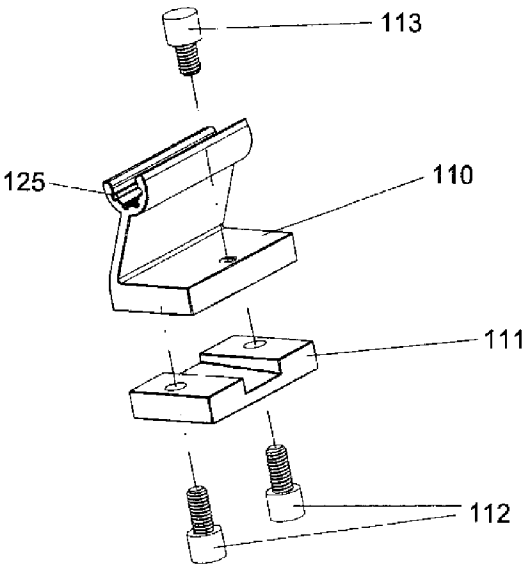
FIG. 7 is an exploded perspective view of FIG. 6, which is intended for use in sharpening a chisel.

FIGS. 6 and 7 show the same sharpening tool of FIG. 1 being used with an alternative blade holder 110, for use in holding a different tool to be sharpened, such as a chisel. In this case, a chisel toe plate 111 is secured to the blade holder 110 by means of clamping screws 112. The toe plate 111 has a recess for receiving the blade of the chisel, as shown in phantom in FIG. 6. There also is a set screw 113, which clamps the chisel blade against the toe plate 111. Blade holder 110 has a slide bearing 125 partially opened along its length which engages the guide rod 101 in the same manner as the previously described bearing 114. Other shapes of toe plates and/or tool holders could be used instead of the toe plate 111 and blade holder 110 for holding other tools.

Figure 7B:
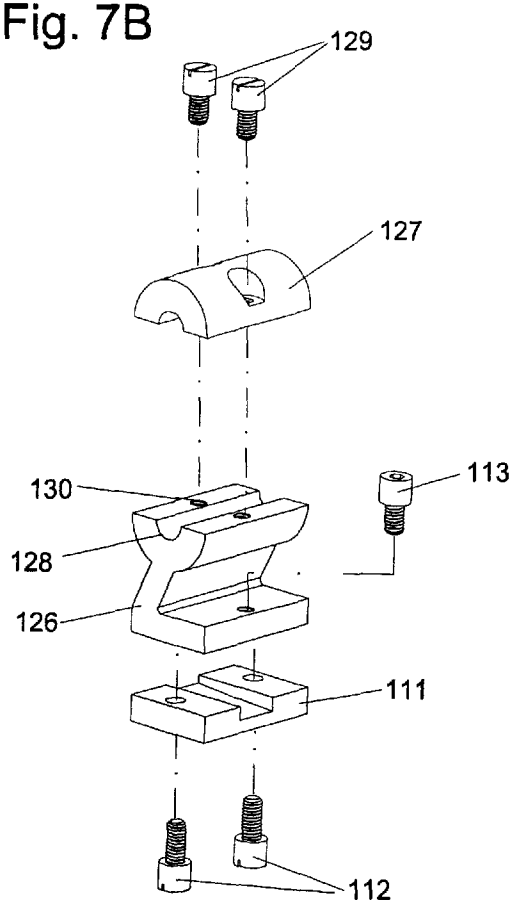
FIG. 7B is an exploded perspective view of the embodiment of an adaptor of FIG. 7A, which shows the cap removed.
Figure 7A:
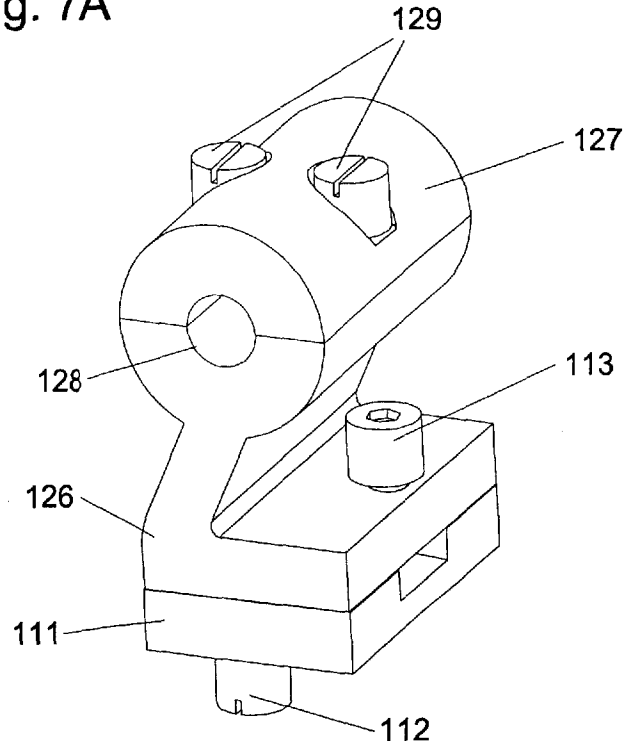
FIG. 7A is a perspective view of an alternate adaptor having a cap on the open bearing which can be put in place to enclose a guide after the bearing is placed on a guide.

Referring now to FIG. 7A, another embodiment of a blade holder 126 is shown. In that embodiment, bearing cap 127 allows partially open slide bearing 128 on blade holder 126 to be closed around a guide rod after it has been positioned on the guide rod. Although the bearing cap 127 in FIG. 7A provides a 360 degree enclosure of the rod, other embodiments of bearing cap 127 may create a wrapping of less than 360 degrees about the guide rod. The extent of wrapping about the guide rod deemed necessary is determined by the application and the loads generated by the application.

FIG. 7B is an exploded perspective view of the blade holder 126 of FIG. 7A. In FIG. 7B additional screws 129 and matching apertures 130 provide the means of attaching bearing cap 127 to blade holder 126. Other elements of blade holder 126 shown in FIGS. 7A and 7B are similar to the embodiment of blade holder 110 shown in FIGS. 6 and 7.

Figure 7C:
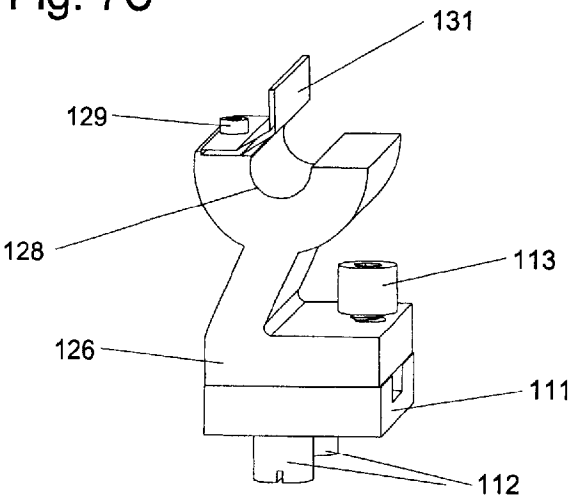
FIG. 7C is a perspective view of an embodiment of an adaptor, which has a clip attached near an open bearing.

FIG. 7C is a perspective view of an embodiment of blade holder 126 which has clip 131 attached near, or on, open bearing 128. Clip 131 has a spring quality to it. Once bearing 128 of blade holder 126 is installed on a guide such as guide rod 101 in the sharpener discussed above, clip 131 retains bearing 128 in contact with the guide. Clip 131 may be attached with a screw or any of several possible alternative means of attachment. It may also be located on either side of bearing 128.

Figure 8A:
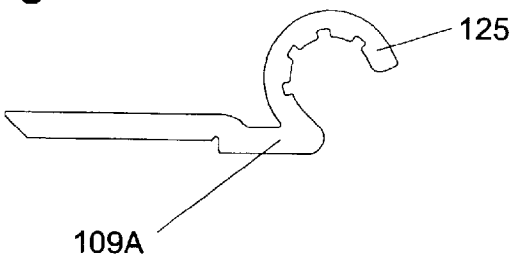
FIG. 8A is a side view of the partially closed bearing of FIG. 5A.
Figure 8C:
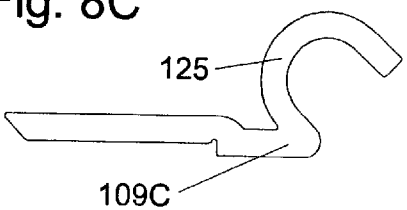
FIG. 8C is an example of another alternate bushing, without surface reducing groves in the bearing surface.
Figure 8B:
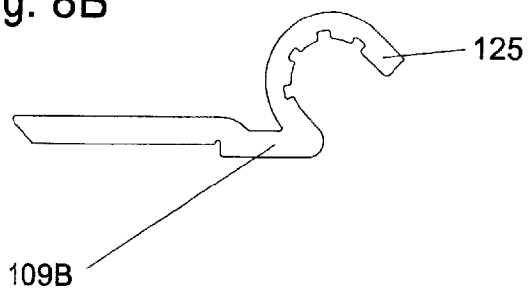
FIG. 8B is an example of an alternate bushing, with a fully open bearing.

FIGS. 8A, 8B, and 8C show several embodiments of slide bearing 125. In the embodiment shown in FIG. 8A, the internal surface of slide bearing 125 encloses an angle greater than 180 degrees. In this embodiment slide bearing 125 can "snap" over guide rod 101 and thereafter provide some measure of retention of blade holder 105 without assistance. In order to do this, slide bearing 125 must have sufficient flexibility. This flexibility may be due to the inherent flexibility of the material of bearing 125 or may result as much from the design of bearing 125. The embodiment of slide bearing 125 in FIG. 8B does not have the capability to wrap around guide rod 101. Because of this, slide bearing 125 of FIG. 8B may be made of a more rigid, or harder, material. This may be desirable for wear durability. The embodiment of slide bearing 125 shown in FIG. 8C has a smooth bearing surface in contrast to the embodiments of bearing 125 in FIGS. 8A and 8B, which have surface reducing grooves.

OPERATION

Figure 3:
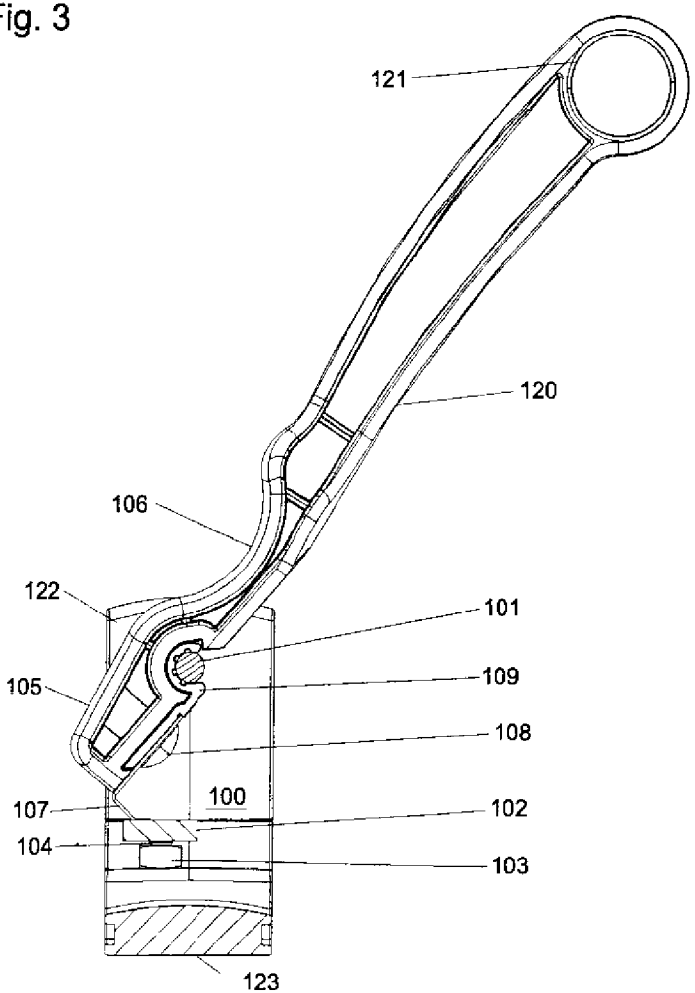
FIG. 3 is a side section view taken through the sharpener of FIG. 1 at the plane indicated.

As illustrated in FIG. 1, the blade holder 105 and its attachments are mounted on the guide rod 101 and are positioned to be pulled along the sharpening element 102 to the position shown in FIG. 2 in order to sharpen the scraper blade 107. The sharpening element 102 in this embodiment is a file and cuts only in one direction, so after completing a first pass from right to left (from the position shown in FIG. 1 to the position shown in FIG. 2), the blade holder 105 is placed back in its original position shown in FIG. 1 and is pulled across the file 102 again for further sharpening. Once the scraper blade 107 has been sharpened, the scraper tool is disengaged from the guide rod 101 as shown in FIG. 5, ready for use on a work surface. FIG. 3 shows how the bushing 109 is received in a recess in blade holder 105, and how blade 107 is clamped against the flat portion of the bushing 109 and against the blade holder 105 by means of the clamp screw 108. It also shows how bearing 114 wraps around the guide bar 101, as discussed above with respect to FIG. 8A. This bearing 114 has grooves in the curved surface that wraps around the guide bar 101 to reduce the surface area of contact between the bushing 109 and the guide bar 101.

As the scraper blade 107 is sharpened and mass is lost from the blade 107, the angle between the tip (the sharp edge) of the blade 107 and the sharpening surface 116 of sharpening element 102 is reduced, which results in a smaller angle on the edge, but sharper scraper blade 107.

The arrangement shown in FIGS. 1, 2, 3 and 4 is for a right handed person, with the scraper blade 107 positioned on the left side of the guide rod 101. Alternatively, for sharpening elements 102 that act in only one direction, the sharpening element 102 can be turned 180 degrees and the sharpening motion would be accomplished with a push rather than pull, or if the blade holder is being held by a left handed person, he could turn the sharpener 180 degrees and push the blade holder 105 along the guide rod 101 to sharpen. This enables both left and right handed people to share sharpening tool without changing the set up. As the sharpening element 102 is worn with use, it can easily be repositioned so that fresh and or unworn areas of the sharpening element 102 contact the blade 107 by loosening the tensioning screws 104 and the nut 103 and repositioning the sharpening element 102.

The frame 100 holds the guide rod 101 parallel to the sharpening element 102 and at a height conducive to enable sharpening of the scraper blade 107.

FIG. 6 shows the frame 100 and assembly being utilized to sharpen a chisel. In this arrangement, the chisel is moved across the sharpening element 102 parallel and square to sharpening surface 116.

The above description describes only a few embodiments of the present invention. These are not the only ways the invention could be made. The scope of the invention should be determined by the claims and their legal equivalents and should not be limited to the examples shown and described here.

I claim:

1. A combination including an edge tool and sharpening tool for maintaining a sharpened edge on said edge tool, said combination comprising:

said sharpening tool comprising: a frame, a sharpening element, and a guide;

said sharpening element being mounted in said frame;

said guide being a rod mounted in said frame in a substantially parallel spaced relationship to said sharpening element; and, said edge tool comprising: at least one blade, at least one blade mounting surface, means for holding said at least one blade on said at least one blade mounting surface, and a handle including a notch comprising sides wherein a bearing is recessed within said notch and said sides of said notch leading into said bearing, wherein said bearing further comprises a cylindrical surface sized to pivotally engage said guide, and said edge tool when mounted on said guide is configured to pivot towards said sharpening element for sharpening said at least one blade.

2. The combination including the edge tool and sharpening tool of claim 1, further comprising:

a spring clip attached to said edge tool in proximity to said bearing, said spring clip fitting over said guide when said bearing is engaged on said guide and said spring clip maintains said bearing in contact with said guide.

* * * * *